US006641427B1

(12) United States Patent
Kreutzer

(10) Patent No.: US 6,641,427 B1
(45) Date of Patent: Nov. 4, 2003

(54) DEVICE FOR CONTACTING AN ELECTRIC LINE, ESPECIALLY A FLAT CONDUCTOR CABLE

(75) Inventor: Rainer Kreutzer, Weiden (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/088,161

(22) PCT Filed: Sep. 4, 2000

(86) PCT No.: PCT/DE00/03040

§ 371 (c)(1),
(2), (4) Date: Mar. 15, 2002

(87) PCT Pub. No.: WO01/20723

PCT Pub. Date: Mar. 22, 2001

(30) Foreign Application Priority Data

Sep. 15, 1999 (DE) ..... 199 44 312

(51) Int. Cl.[7] ..... H01R 11/20

(52) U.S. Cl. ..... 439/397; 439/839; 439/408; 439/395

(58) Field of Search ..... 439/395, 839, 439/408, 397, 398, 400, 403, 405

(56) References Cited

U.S. PATENT DOCUMENTS

| | | | | | |
|---|---|---|---|---|---|
| 3,027,536 | A | * | 3/1962 | Pasternak | 439/403 |
| 4,062,615 | A | * | 12/1977 | Navarro | 439/400 |
| 4,089,580 | A | * | 5/1978 | Huffnagle et al. | 439/400 |
| 4,270,831 | A | | 6/1981 | Takahashi | |
| 4,806,119 | A | * | 2/1989 | Herfort et al. | 439/395 |
| 5,447,449 | A | * | 9/1995 | Kaneko | 439/403 |

FOREIGN PATENT DOCUMENTS

| | | |
|---|---|---|
| DE | 1117684 | 11/1961 |
| DE | 35 45 305 | 6/1987 |
| DE | 198 54 200 A1 | 6/2000 |
| EP | 854019 | 11/1960 |
| EP | 893 845 A2 | 1/1999 |
| FR | 2 097 279 | 3/1972 |

* cited by examiner

*Primary Examiner*—Tho D. Ta
(74) *Attorney, Agent, or Firm*—Harness, Dickey & Pierce, P.L.C.

(57) ABSTRACT

A device for contacting an electric line includes a contact element, which has at least two contact tongues on the side facing the line. To achieve secure contacting, the contact element includes clamping halves, which are arranged resiliently in relation to one another.

29 Claims, 9 Drawing Sheets

DEVICE FOR CONTACTING AN ELECTRIC LINE, ESPECIALLY A FLAT CONDUCTOR CABLE

This application is the national phase under 35 U.S.C. §371 of PCT International Application No. PCT/DE00/03040 which has an International filing date of Sep. 4, 2000, which designated the United States of America, the entire contents of which are hereby incorporated by reference.

FIELD OF THE INVENTION

The invention generally relates to a device for contacting an electric line. Preferably it relates to a device for contacting a flat conductor cable.

Device of this type may be required, for example, in the area of so-called power bus systems, in which a large number of loads, for example engines etc., are connected to a multi-core flat conductor cable.

BACKGROUND OF THE INVENTION

DE 198 54 200.3 (SIEMENS) discloses a device for contacting an electric line in which the contact tongues of a contact element lying opposite one another and spatially offset in relation to one another penetrate the line to be contacted, so that a line to be contacted is pressed between the contact tongues and is consequently held with multiple surface contact over large areas.

After a certain period in use, however, an undesired reduction in the contact bearing force may occur in the case of such contacting, on account of yielding of the contacted line.

SUMMARY OF THE INVENTION

An embodiment of the invention is based on an object of specifying a device for contacting an electric line which permits more secure contacting even over a prolonged period of time.

Such an object can be achieved by a device for contacting an electric line.

The device according to an embodiment of the invention for contacting an electric line can include a contact element which includes clamping halves, which are arranged resiliently in relation to one another. The spring force occurring can achieve the effect that an adequate contact bearing force between the clamping halves and the contacted line occurs even after a prolonged period in use and when there are temperature fluctuations and/or current pulse loads.

If, with increasing time in use or on account of thermal and/or electrical loads, a mechanical deformation of the contacted conductor occurs, this can be compensated by the resilient clamping halves of the device according to an embodiment of the invention and permanent contacting can be achieved. The clamping halves bear with spring-biased action against the contacted line, so that a constant and secure contact can be achieved.

Springing of the clamping halves can be accomplished on the one hand by suitable intrinsic resilience of the material and on the other hand or in addition by a spring element to act on the clamping halves.

According to an advantageous embodiment, the clamping halves are pivotably interconnected via points of attachment or pivot points, the contacted line being located between the contact tongues of the clamping halves when the clamping halves have penetrated and are bearing against it.

The clamping halves can be opened and closed about the points of attachment or pivot points in the manner of the sides of an angle.

In this case, the opening angle of the clamping halves can be advantageously restricted in the outward and/or inward direction using stops. A maximum opening angle can be achieved by outer stops, so that, in the case of relatively hard insulating material of the line to be contacted, it can be possible to avoid the clamping halves from being pressed too far apart.

Furthermore, it is possible by inner stops and by accomplishing a minimum opening angle, to achieve the effect that the clamping halves maintain a minimum distance in relation to one another, in order to avoid excessive compressive loading or severing of the contacted line.

If the spring element applies pressure to the two clamping halves, on their outer side in each case, the inner side, and consequently the space for holding the contacted line, is not subjected to any loading.

Structural design advantages can be achieved if the clamping halves are fitted into one another via a plug-in connection and can be arrested and interconnected by a spring element which can be pushed on.

In a further embodiment of the invention, especially secure contacting of the line held is achieved by stamped formations (elevations and depressions), which are provided on the contact tongues of the clamping halves and are facing the contacted line.

When these stamped formations take the form of cutting edges, the necessary clamping force for severing the insulation of the conductor can be applied and then the required contact bearing force can be introduced into the line. Consequently, the required surface pressing to accomplish an adequate contact bearing force can be accomplished even over a prolonged period in use and under thermal and electrical loads.

Penetration of the clamping halves into the insulation and the conductor to be contacted itself is also facilitated by the contact tongues of the clamping halves having cutting tips.

If these cutting tips merge over a flat area into the stamped formations of the contact tongues of the clamping halves, both a constant penetration of the contact tongues into the insulation and the line and a uniform build-up of the contact bearing force of the clamping halves on the conductor in the introduced final contacting position are achieved especially reliably.

The device according to an embodiment of the invention is arranged in a housing, with actuation of an adjusting screw causing a displacement of the device in the housing, so that the clamping halves with the clamping tongues penetrate into the insulating material and the conductor of the line to be contacted.

In this case, guiding areas for bearing the device for contacting when it is being displaced in the housing are advantageously provided on the device according to an embodiment of the invention.

The pressing-in force can be introduced over a flat area into the line to be contacted during the fastening of the device via pressing-in areas. The movement of the adjusting screw during loosening can be transferred to the clamping halves by pulling-out areas engaging in the clamping halves.

BRIEF DESCRIPTION OF THE DRAWINGS

The invention is explained in more detail in the exemplary embodiments on the basis of the drawings, in which.

DETAILED DESCRIPTION OF THE PREFERRED EMBODIMENTS

Figure 1:
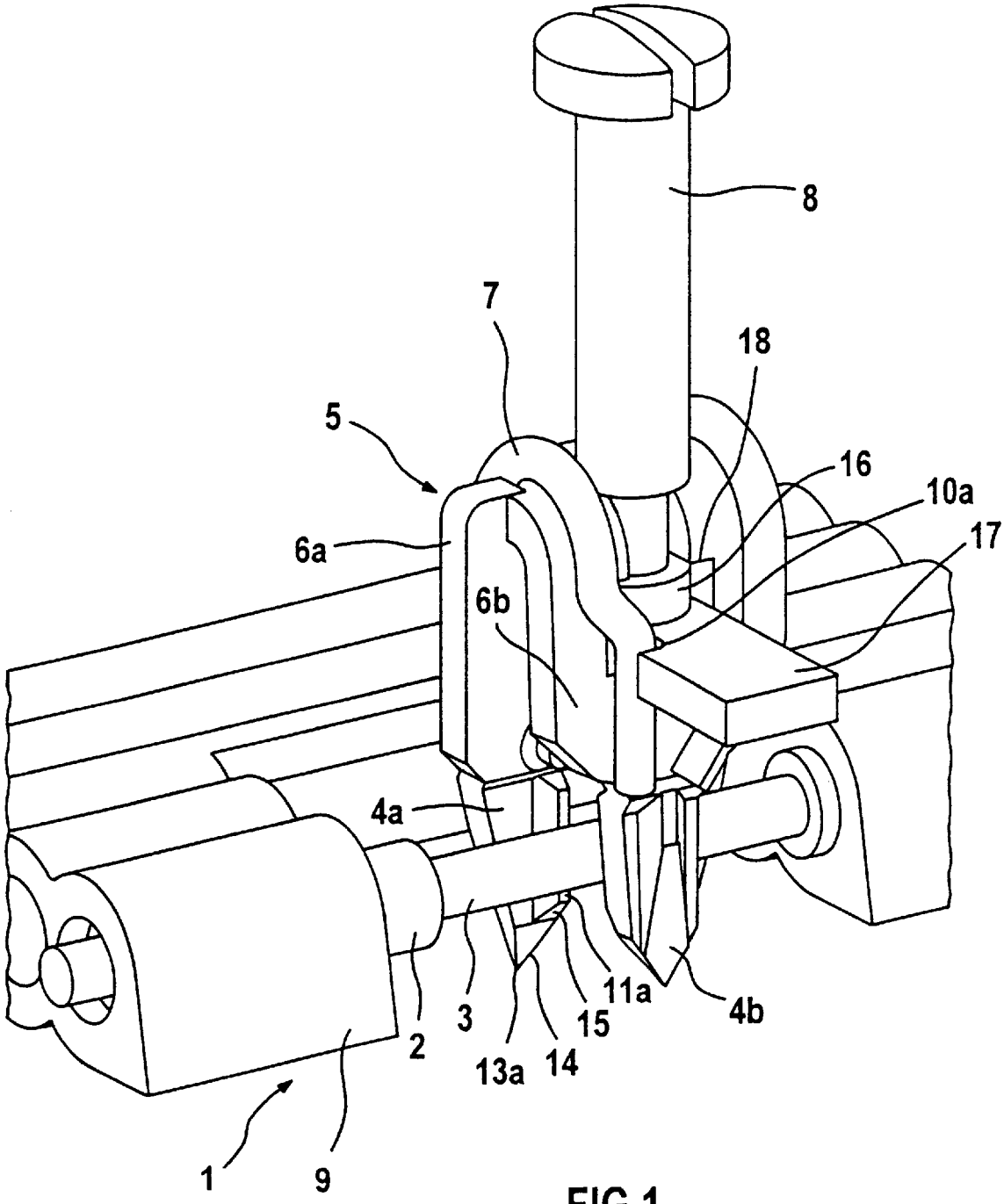
FIG. 1 shows an overall view of the device for contacting in the state in which it is fitted on a flat conductor cable.

FIG. 1 shows a device for contacting which is attached to a flat conductor cable 1, the insulation 9 of the flat conductor cable 1 having been removed, and consequently the line 2 and its inner conductor 3 exposed, in the region of attachment for the purposes of illustration. The depicted device for contacting may be located in a housing, as is already known from DE 198 54 200.3 (SIEMENS), with actuation of the adjusting screw 8 during fastening achieving the effect, in the manner described there, that the contact tongues 4*a, b* and *c* (the latter is concealed) penetrate into the flat conductor cable 1, the respective line 2 and its inner conductor 3 until the same are penetrated.

FIG. 1 also shows a spring element 7, which is formed in the manner of a bow and onto which are pushed clamping halves 6*a*, 6*b* of the device for contacting, forming the contact element 5. On the outer side, pressure is applied to the clamping halves 6*a*, 6*b* by the spring element 7 in the radial direction with respect to the extent of the line 2. The clamping halves 6*a* and 6*b* engage positively in one another and are held in the connected position by the pushed-on spring element 7.

On the device for contacting there is, in a pressing-in area 17, an outer stop 10*a* for limiting the spring excursion of the spring element 7. This determines the maximum opening angle α (cf. FIGS. 2 and 3) between the clamping halves 6*a*, 6*b*. The pressing-in area 17 serves for introducing the pressing-in force over a flat area during fastening, that is during closing of the adjusting screw 8. The external thread of the schematically represented adjusting screw 8 engages in a corresponding internal thread of the housing of the device (neither depicted).

The movement of the adjusting screw 8 during the opening of the device is transferred to the contact element 5 with the clamping halves 6*a* and 6*b* via the positive connection of the pulling-out area 16 to the clamping half 6*b*, at the notch 18 of the latter, so that the contact tongues 4*a–c* are moved out again from the conductor 2.

The contact tongue 4*a* has a cutting tip 13*a*, whereby the penetration into the line 2 is facilitated. In this case, the cutting tip 13*a* merges over a flat area into the stamped formation 11*a* (elevation) of the contact tongue 4*a*, with transitional areas 14, 15 being provided. When the screw 8 is displaced and the device for contacting penetrates into the line 2, a constant transfer can take place from the cutting tip 13*a* to the stamped formation 11*a* through the transitional areas 14, 15.

Figure 2:
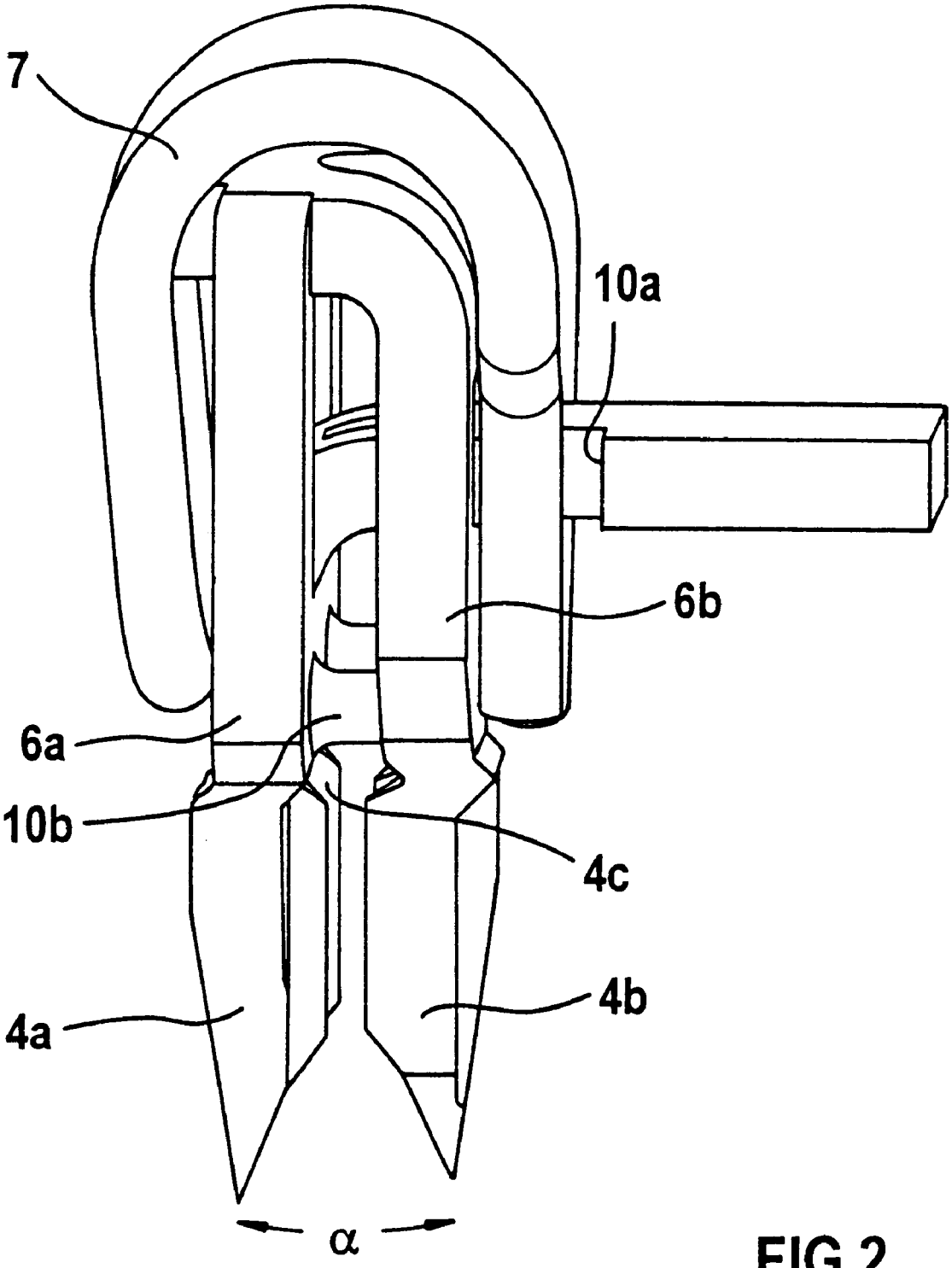
FIG. 2 shows a side view of the device for contacting, with closed clamping halves.

FIG. 2 shows a separate illustration of the device for contacting, without a held line 2 or flat conductor cable 1. In this case, the clamping halves 6*a*, 6*b* have been pressed together completely by the pushed-on spring element 7, so that a minimum opening angle α is obtained between the contact tongues 4*a–c*.

In general, the arrangement of the contact tongues 4*a–c* can correspond to the arrangement of the corresponding contact tongues from the cited DE 198 54 200.3 (SIEMENS).

The two clamping halves 6*a*, 6*b* have been inserted positively into one another and are pivotably interconnected, with the clamping half 6*b* resting on the inner stop 10*b* of the clamping half 6*a* in the completely pressed-together state depicted.

Figure 3:
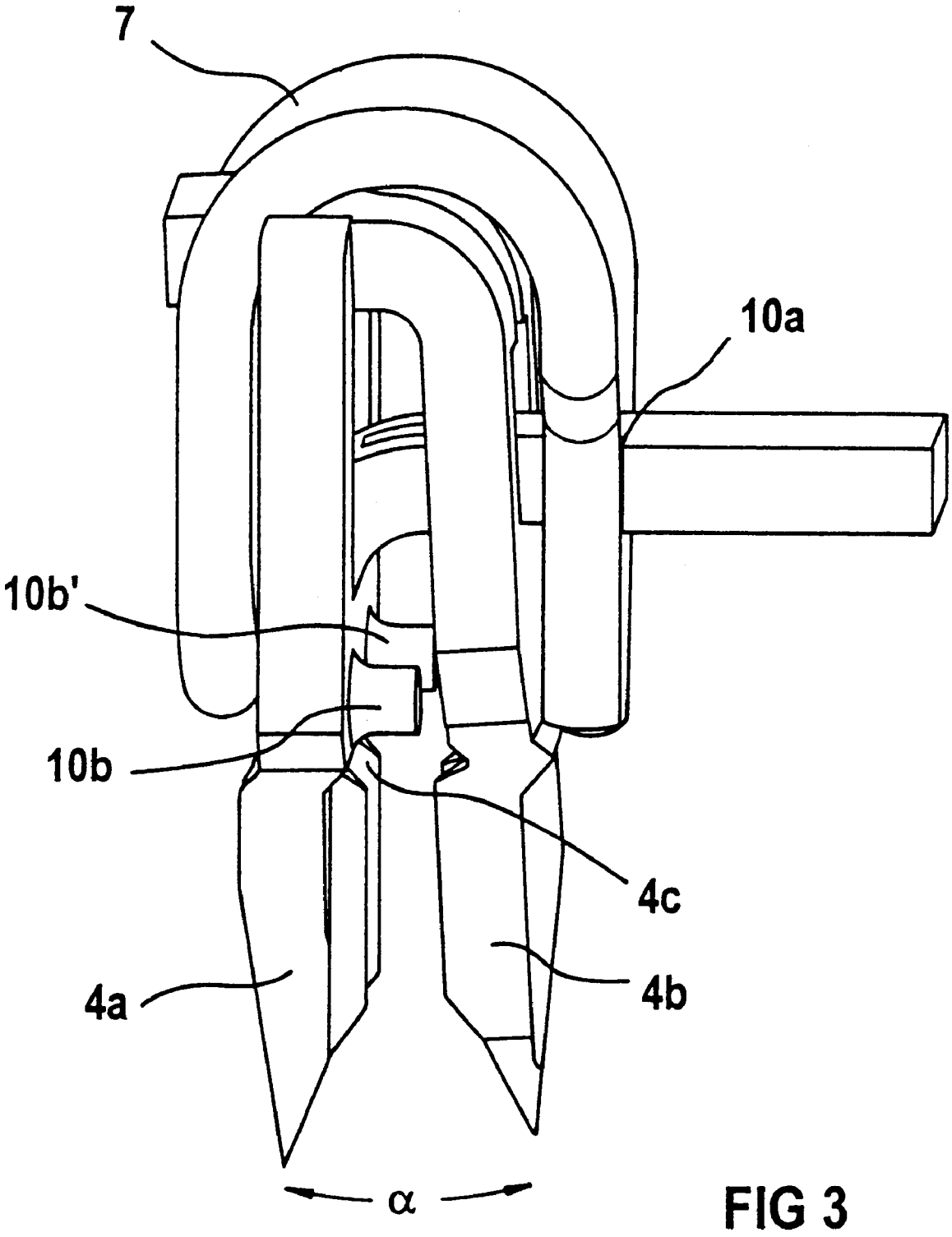
FIG. 3 shows a side view of the device for contacting, with open clamping halves.

FIG. 2 also shows the outer stop 10*a*, which achieves an upward restriction of the opening angle α (cf. FIG. 3).

FIG. 3 shows the device for contacting, like FIG. 2 without the electric line 2 and the flat conductor cable 1 being depicted. The clamping halves 6*a*, 6*b* are in this case in a completely open state, so that the spread-open spring element 7 is restricted in its opening by the outer stop 10*a*, and consequently the opening angle α has an upward limitation. The inner stops l0*b*, 10*b*' are exposed.

Figure 4:
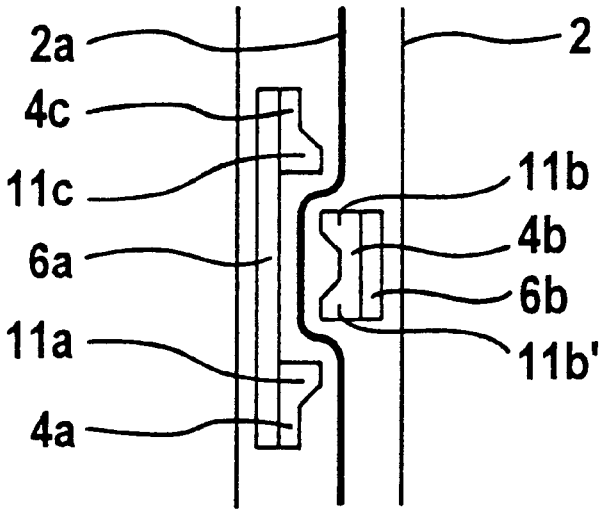
FIG. 4 shows a basic representation showing the contacting of a conductor with the device for contacting.

FIG. 4 presents a basic representation for the contacting of a conductor 2. The view according to FIG. 4 is obtained in a sectional representation of FIG. 1 in the region of the inner conductor and the contact tongues 4*a–c*.

FIG. 4 shows the bowed contour of a geometrical line 2*a*, which can be regarded as individual conductors within the line 2, between the clamping halves 6*a*, 6*b*. The contact tongues 4*a–c* have in this case the stamped formations 11*a*, 11*b*' and also 11*c* (elevations), as a result of which the pressing force of the spring-biased clamping halves 6*a*, 6*b* on the geometrical line 2*a* is increased.

This produces the desired stable contact bearing force over a prolonged period in use even under different thermal and electrical operating conditions.

The stamped formations 11*a–c* are formed on the contact tongues 4*a–c* as projections facing the line 2 to be contacted, in particular the geometrical line 2*a*, take the form of cutting edges and, to accomplish different contact bearing forces, may also have a rounded or angular profile (not depicted).

Figure 5:
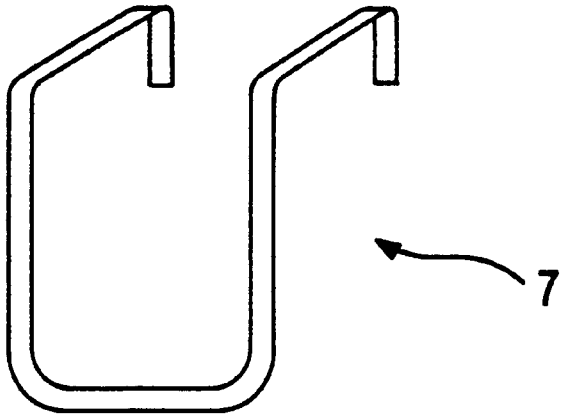
FIG. 5 shows a basic representation of a spring element for the device for contacting.

FIG. 5 shows a schematic illustration of the spring element 7 which is formed in the manner of a bow and is pushed from above over the clamping halves 6*a*, 6*b*, in order to apply pressure to the outer sides of the latter. In general, other embodiments of spring elements can also be used, for example spiral spring elements integrated into the clamping halves 6*a*, 6*b* (not depicted).

The desired springing of the clamping halves 6*a*, 6*b* of the contact element 5 can also (additionally) be accomplished by suitable materials with an intrinsic resilience of the clamping halves 6*a*, 6*b*.

Figure 6:
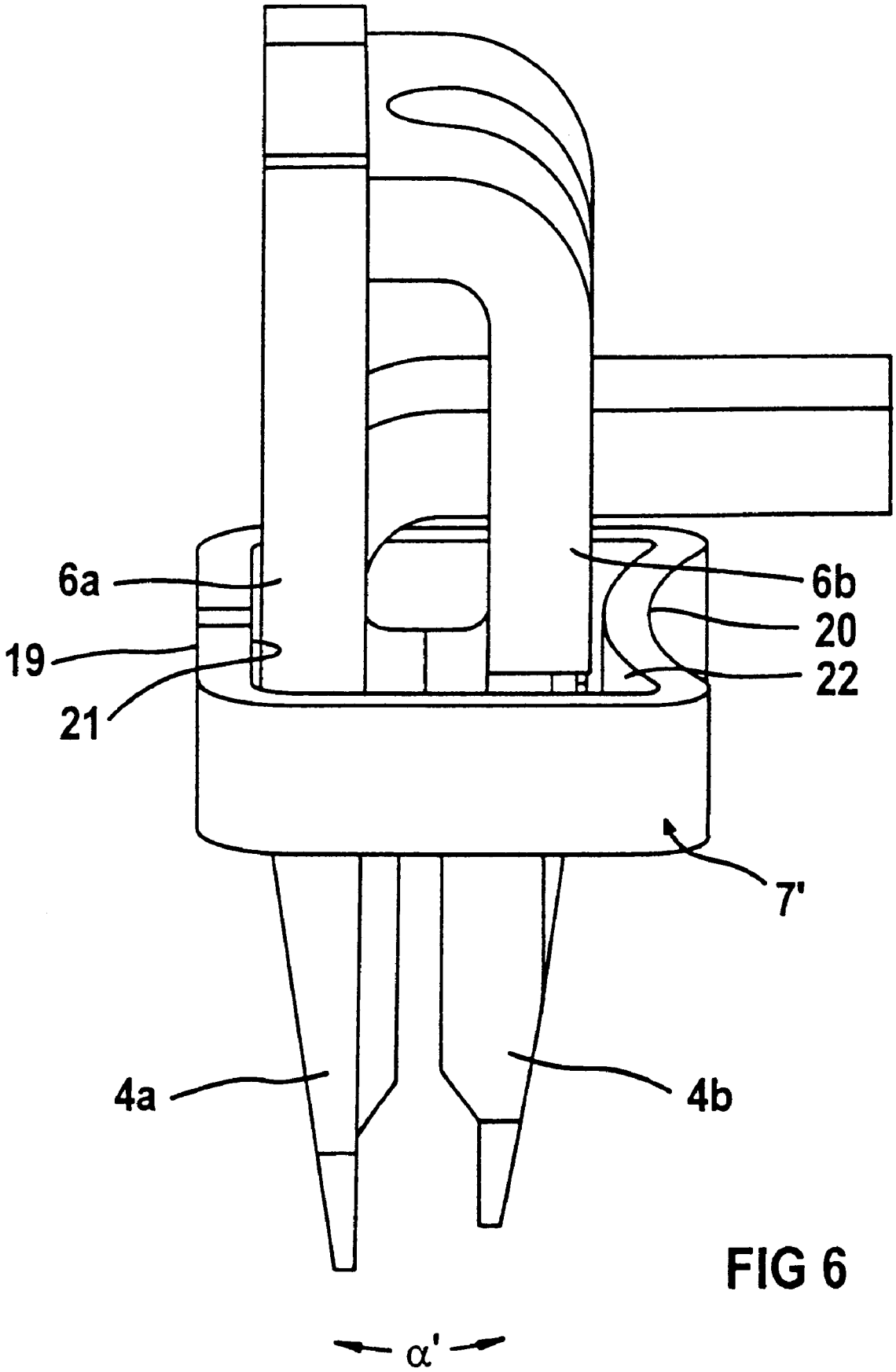
FIG. 6 shows a side view of the device for contacting with a spring element in a further embodiment, with closed clamping halves.

FIG. 6 in turn shows a separate illustration of the device for contacting without a held line 2 or flat conductor cable 1. In this case, the clamping halves 6*a*, 6*b* have been completely pressed together by a spring element 7' pushed on from below, so that a minimal opening angle α is obtained between the contact tongues 4*a*–4*c*.

The spring element 7' according to FIG. 6 consists in particular of flat material, takes the form of a box with a substantially rectangular cross section and is pushed on from below over the clamping halves 6*a*, 6*b*, in order to apply pressure to the outer sides of the latter. The spring element 7' in this case acts as a resilient box frame, the side regions 19 and 20 of which in particular resiliently contact the clamping halves 6*a*, 6*b*, especially in their open state (cf. FIG. 7). In the relieved state, the side region 20 may be shaped in the form of a bow, as depicted in FIG. 6, the bowed profile of which diminishes or completely straightens when a spring force is exerted on the clamping half 6*b* when the clamping halves 6*a*, 6*b* are open (cf. FIG. 7).

Figure 7:
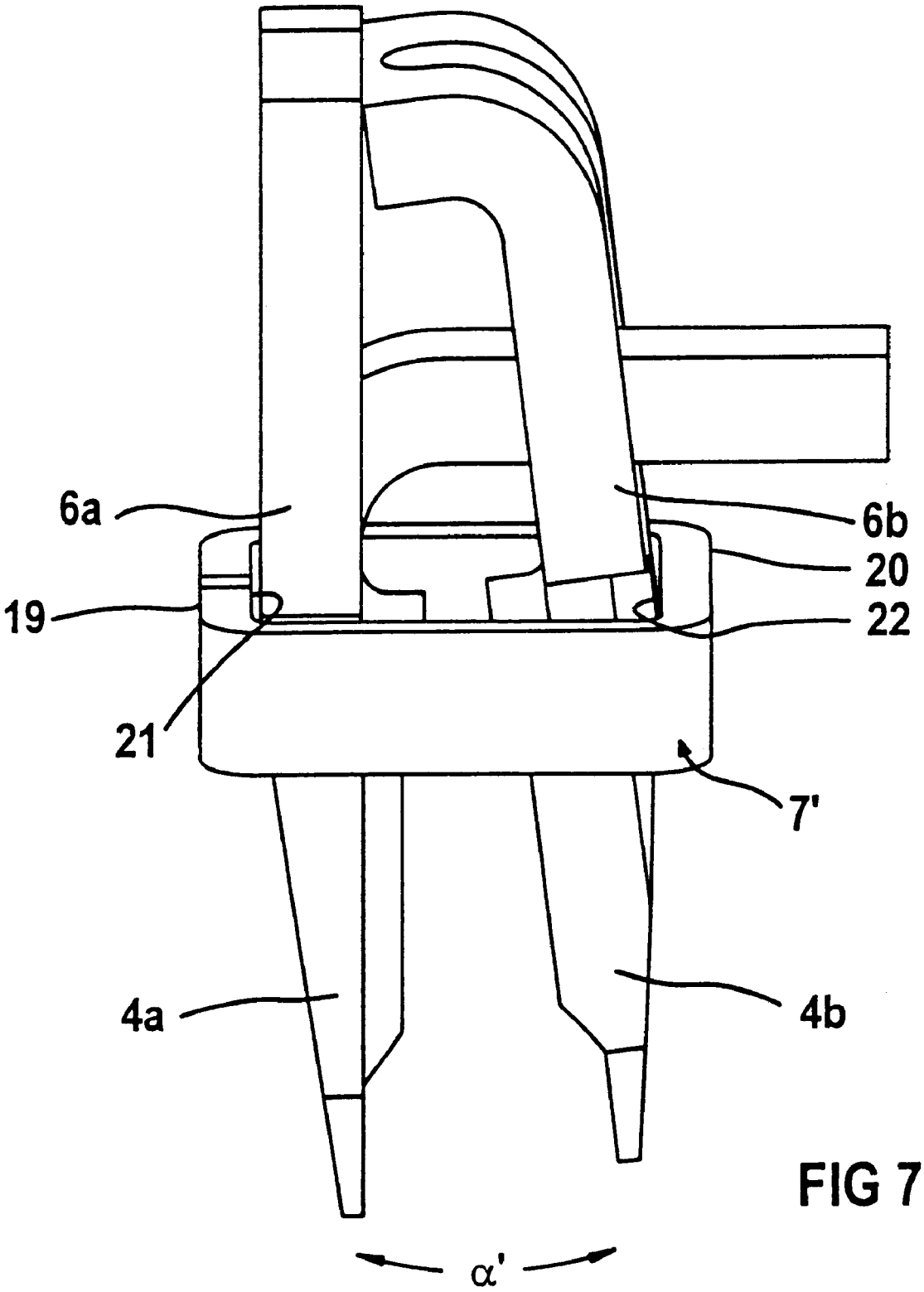
FIG. 7 shows a side view of the device according to FIG. 6, with open clamping halves.

The box-shaped spring element 7' according to FIGS. 6, 7 has the effect of creating a defined stop for the opened clamping halves 6*a*, 6*b*, which is formed by the inner regions 21, 22 of the side regions 19, 20. Consequently, the opening width of the two clamping halves 6*a*, 6*b*, and consequently the maximum opening angle $\alpha$, can be determined by the inner corner dimension of the box-shaped spring element 7', that is the distance between the inner regions 21, 22 of the side regions 19, 20.

Figure 8:
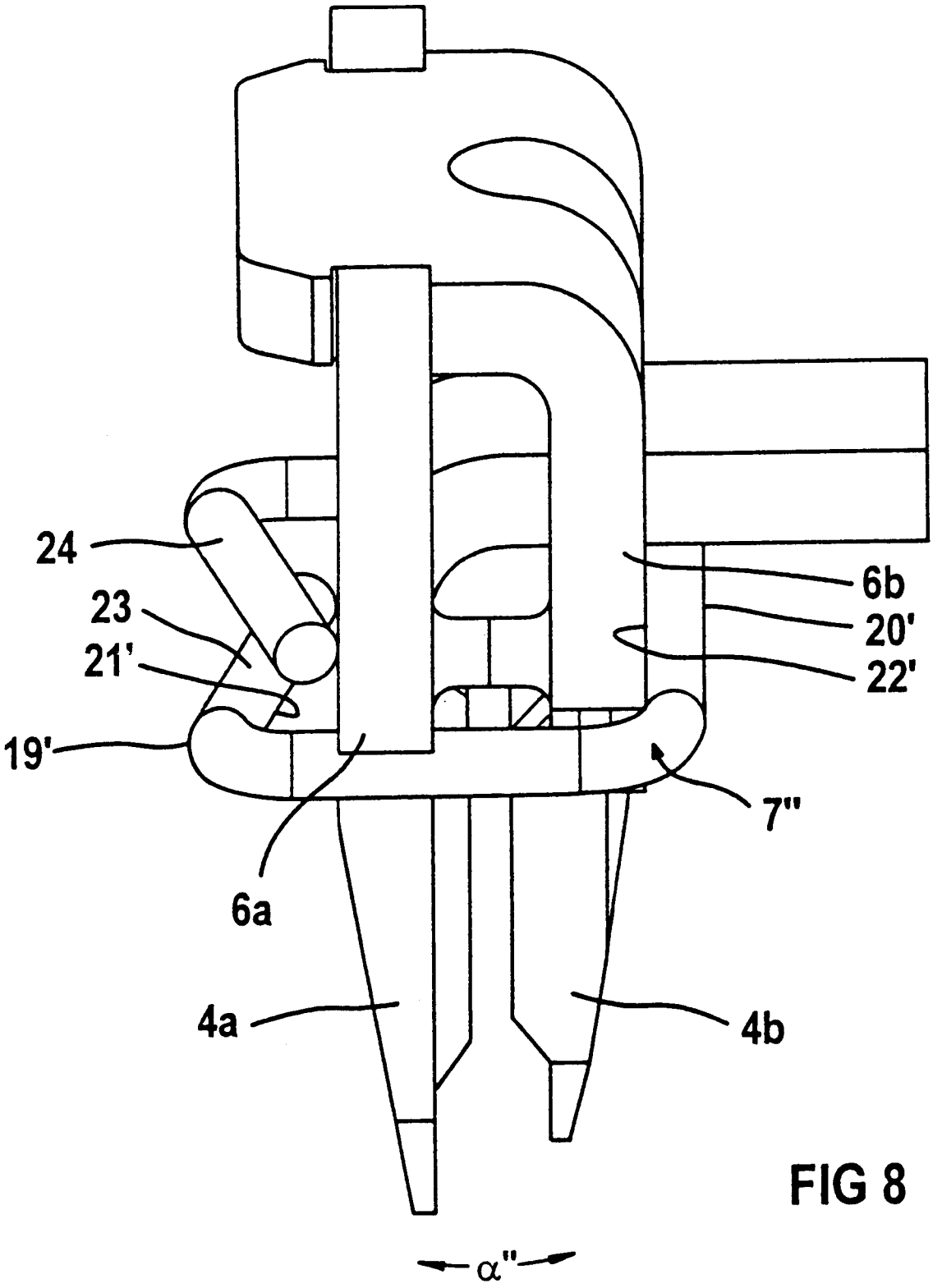
FIG. 8 shows a side view of the device for contacting with a spring element in a further embodiment, with closed clamping halves.

FIG. 8 shows a further device for contacting without a held line 2 or flat conductor cable 1. In this case, the clamping halves 6*a*, 6*b* have been completely pressed together by a spring element 7" pushed on from below, so that a minimum opening angle $\alpha$" is again obtained between the contact tongues 4*a*–4*c*.

The spring element 7" according to FIG. 8 consists in particular of round material and has in the relieved state bent-in spring ends 23 and 24, which exert a spring force on the outer sides of the clamping halves 6a and 6b. When the clamping halves 6*a* and 6*b* are open, the spring ends 23 and 24 are bent out or completely straightened (FIG. 9).

Figure 9:
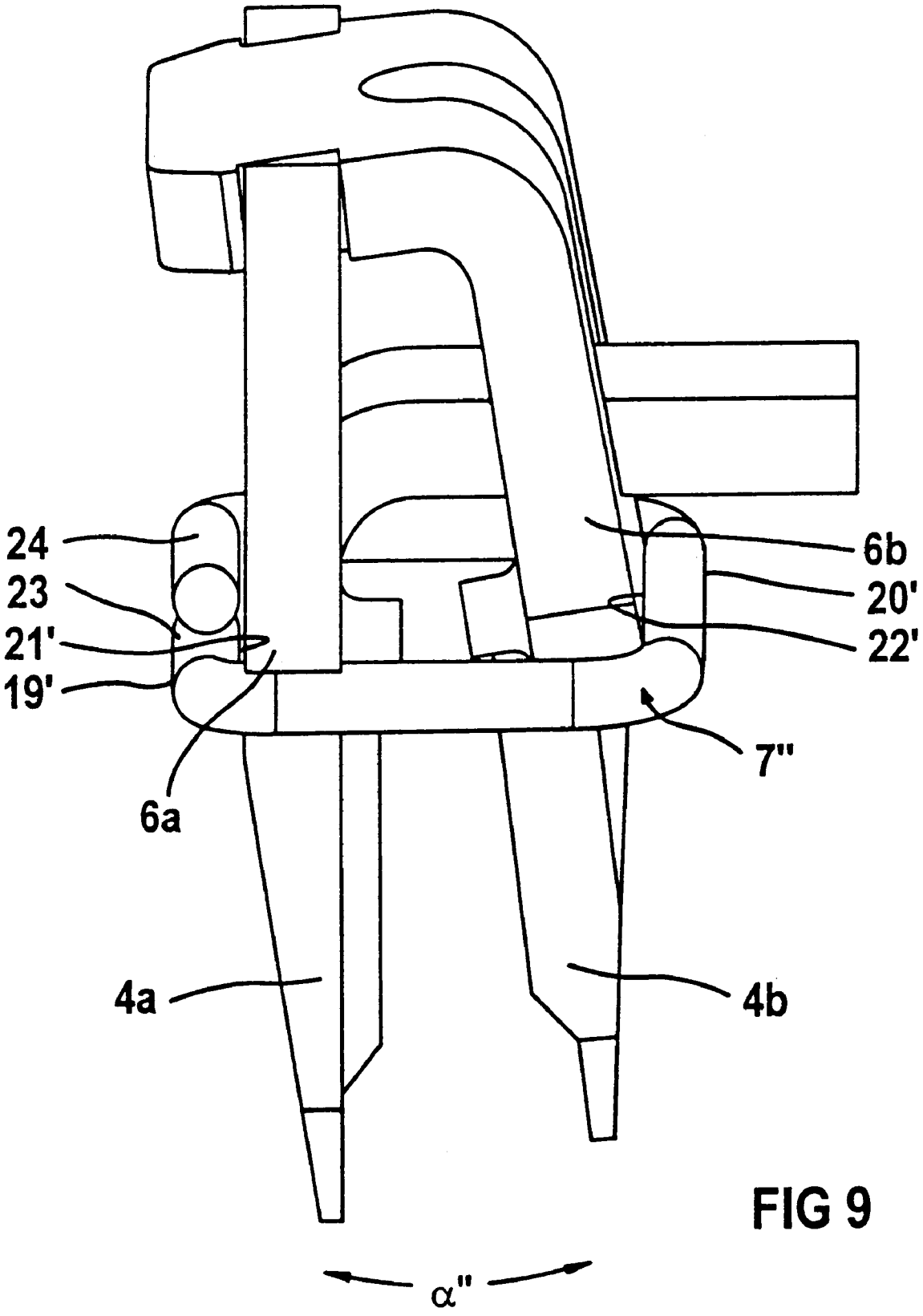
FIG. 9 shows a side view of the device according to FIG. 8, with open clamping halves

It is also the case with the spring element 7" according to FIGS. 8 and 9 that a defined stop for the open clamping halves 6*a*, 6*b* is created, formed by the inner regions 21', 22' of the side regions 19', 20' of the spring element 7". Consequently, the opening width of the two clamping halves 6*a*, 6*b*, and consequently the maximum opening angle $\alpha$", can again be determined by the inner corner dimension of the spring element 7", that is the distance between the inner regions 21' 22' of the side regions 19', 20'.

Figure 10:
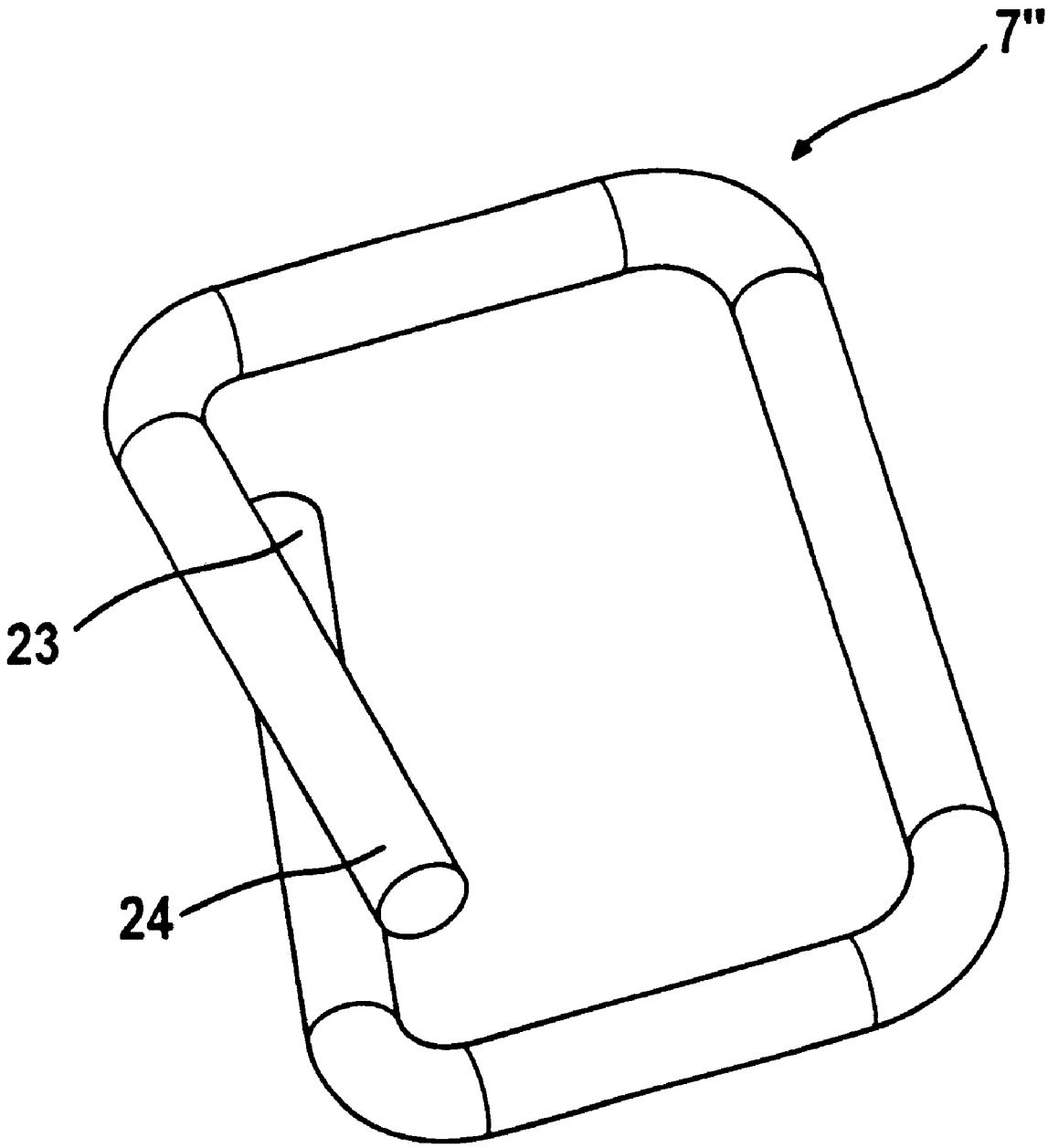
FIG. 10 shows a basic representation of a spring element according to FIG. 8 for the device for contacting.

In FIG. 10, the spring element 7" with the spring ends 23 and 24 and the side regions 19' and 20' is separately presented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for contacting an electric line comprising:

a contact element, including clamping halves arranged resiliently in relation to one another, and including at least two contact tongues, on a side facing the electric line, the contact tongues being provided for penetrating the electric line to be contacted and being spatially offset with respect to one another with reference to an axis of the electric line to be contacted in such a way that an inner conductor to be contacted of the electric line to be contacted is pressed between the contact tongues when the clamping halves penetrate through the electric line, wherein contact tongues include stamped formations and cutting tips facing the electric line to be contacted and wherein at least one clamping half is connected via a pulling-out area to an adjusting screw for loosening the device.

2. The device as claimed in claim 1, further comprising at least one stop, for limiting an opening angle of the clamping halves in at least one of the outward and inward direction.

3. The device as claimed in claim 1, wherein the cutting tips merge over a flat area into the stamped formations.

4. The device as claimed in claim 1, wherein the clamping halves include at least one guiding area for bearing purposes in a housing of the device.

5. The device as claimed in claim 1, further comprising a pressing-in area for applying the pressing-in force over a flat area during fastening of the device.

6. The device as claimed in claim 5, wherein the pressing-in area includes a stop for limiting opening angle of the clamping halves in the outward direction.

7. The device as claimed in claim 1, wherein the clamping halves are interconnected by a plug-in connection and a spring element.

8. The device as claimed in claim 1, wherein the clamping halves are interconnected by a spring element.

9. The device as claimed in claim 8, wherein the spring element applies pressure to the clamping halves.

10. The device as claimed in claim 8, wherein the clamping halves are interconnected by a plug-in connection and a spring element.

11. The device as claimed in 1, wherein the clamping halves are positively interconnected.

12. The device as claimed in claim 11, further comprising at least one stop, for limiting opening angle of the clamping halves in at least one of the outward and inward direction.

13. The device as claimed in claim 11, wherein the clamping halves are interconnected by a spring element.

14. The device as claimed in claim 13, wherein the spring element applies pressure to the clamping halves.

15. The device as claimed in claim 13, wherein the clamping halves are interconnected by a plug-in connection and a spring element.

16. The device as claimed in claim 1, wherein the stamped formations are in the form of cutting edges.

17. The device as claimed in claim 16, wherein the cutting tips merge over a flat area into the stamped formations.

18. The device as claimed in claim 1, wherein the electric line is a conductor cable.

19. The device of claim 18, wherein the conductor cable is relatively flat.

20. A contact element of a device for contacting an electric line, comprising:

clamping halves arranged resiliently in relation to one another; and at least two contact tongues, on a side facing the electric line, wherein the contact tongues are adapted to penetrate the electric line and adapted to be spatially offset with one another reference to an axis of the electric line, in such a way that an inner conductor of the electric line is pressed between the contact tongues when the clamping halves penetrate through the electric line, wherein the clamping halves include stamped formations and cutting tips facing the electric line to be contacted and, wherein at least one clamping half is connected via a pulling-out area to an adjusting screw for loosening the device.

21. The contact element as claimed in claim 20, wherein the clamping halves are positively interconnected.

22. The contact element as claimed in claim 20, wherein the stamped formations are in the form of cutting edges.

23. The contact element as claimed in claim 20, wherein the cutting tips merge over a flat area into the stamped formations.

24. The contact element as claimed in claim 20, wherein the clamping halves include at least one guiding area for bearing purposes in a housing of the device.

25. The contact element as claimed in claim 20, wherein the clamping halves are interconnected by a spring element.

26. The contact element as claimed in claim 25, wherein the spring element applies pressure to the clamping halves.

27. The contact element as claimed in claim 25, wherein the clamping halves are interconnected by a plug-in connection and a spring element.

28. The contact element as claimed in claim 28, further a pressing-in area for applying the pressing-in force over a flat area during fastening of the device.

29. The contact element as claimed in claim 28, wherein the pressing-in area includes a stop for limiting opening angle of the clamping halves in the outward direction.

* * * * *